United States Patent [19]

Shibasaki et al.

[11] Patent Number: 4,687,318

[45] Date of Patent: Aug. 18, 1987

[54] COPYING APPARATUS

[75] Inventors: Sohei Shibasaki; Yasumasa Iwasaki; Noriki Ono, all of Higashiyamatoshi, Japan

[73] Assignees: Casio Computer Co, Ltd.; Casio Electronics Manufacturing Co., Ltd., both of Tokyo, Japan

[21] Appl. No.: 799,646

[22] Filed: Nov. 19, 1985

[30] Foreign Application Priority Data

Dec. 25, 1984 [JP] Japan ..... 59-195423
Dec. 26, 1984 [JP] Japan ..... 59-272766
Mar. 11, 1985 [JP] Japan ..... 60-35179[U]

[51] Int. Cl.[4] ..... G03G 15/00

[52] U.S. Cl. ..... 355/5; 355/3 R; 355/7; 355/14 R

[58] Field of Search ..... 355/5, 3 R, 1, 7, 14 R; 354/5

[56] References Cited

U.S. PATENT DOCUMENTS 3,473,451 10/1969 Greenly et al. ..... 355/43 X
3,480,360 11/1969 Mallory et al. ..... 355/8
4,194,833 3/1980 Lester et al. ..... 354/5 X
4,367,033 1/1983 Watanabe ..... 355/5
4,541,706 9/1985 Kishi ..... 355/5 X

FOREIGN PATENT DOCUMENTS 55-27889 7/1980 Japan .
56-40341 9/1981 Japan .
57-15885(A) 9/1982 Japan .
59-212070 11/1984 Japan .
59-212866 12/1984 Japan .

*Primary Examiner*—A. C. Prescott
*Attorney, Agent, or Firm*—Sandler & Greenblum

[57] ABSTRACT

The present invention relates to a copying apparatus wherein images on a display member in a display unit can be copied. The copying apparatus comprises the display unit and a copying unit, and light reflected from the images on the display member is supplied to the copying unit through an optical system in the display unit. The present invention discloses what position the copying unit has relative to the display unit and how the display unit is constructed.

5 Claims, 9 Drawing Figures

COPYING APPARATUS

BACKGROUND OF THE INVENTION

1. Field of the Invention

The present invention relates to a copying apparatus, e.g., to an electrophotographic copying machine, and more particularly to a copying apparatus which is capable of copying letters, figures and the like written on a display member, e.g., a blackboard.

2. Discussion of Prior Art

In order to prevent people from doing troublesome work, e.g., transcribing letters, figures and similar characters on notebooks, which characters have previously been written on a display member, e.g., a blackboard used during a conference or lecture, and to prevent mistakes being made during such transcription, copying apparatus has previously been proposed which is capable of directly copying written images from a display member.

For example, letters and other characters are written on an erasable plate-like panel by a felt pen or similar instrument, and the panel, which is held between rollers, is reciprocated upwardly and downwardly to enable letters written on the surface of the panel to be copied.

A recording apparatus has also been proposed in which letters, figures and other characters on a panel are irradiated by light, with the light reflected thereform being read by a reader which includes a pick-up element, e.g., a CCD. The light thus read is converted into electric signals in accordance with a photoelectric conversion and are recorded on sheets of recording paper by a printer or similar device.

With such copying apparatus, however, writing was only placed on a single panel, and such writing had to be erased prior to other writing being placed on the panel.

Additionally, only images on the panel could be copied, and normal originals could not be copied.

Where a reader was employed, the pick-up element, printer and other structure were needed, thus making the cost high. Further, the image recorded by the printer was not formed by clear and fine inclined and curved lines. More particularly, the inclined and curved lines of the copies were formed only by a gathering of dots, i.e., the outline of the inclined or curved lines was not densely filled with dots, but was instead provided in a step-like fashion, thus making it difficult to read the letters, numbers and other characters which were recorded.

SUMMARY OF THE INVENTION

One object of the present invention is to provide a copying apparatus in which a display section is used making it possible to achieve plural copying operations, to form recorded images which are easily readable, which has a relatively low cost and which can be used effectively.

One feature of the present invention resides in a copying apparatus which includes a display unit provided with an erasable sheet-like display member and a copying unit provided with a movable photosensitive body for copying image on the display member, an optical member for moving the display member within the display unit to scan and expose the images on the display member in a successive fashion, as well as to introduce light reflected by the images on the display member to the photosensitive body. The copying unit is located upstream, in the direction of movement of the display member, which display member is moved relative to the surface of the display unit over which the images are written on the display member. The copying unit is located under the display unit.

Another feature of the present invention is that the display unit includes a surface over which images are written, which surface is arranged in a substantially perpendicular fashion to the surface of the display member which is scanned and exposed.

DETAILED DESCRIPTION OF THE DRAWINGS

Figure 1A:
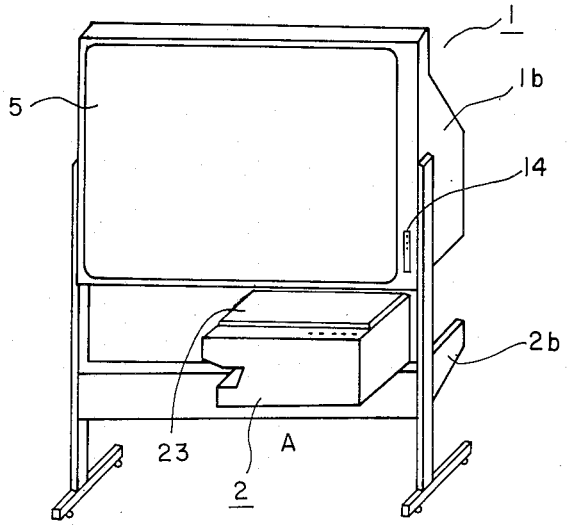
FIGS. 1A and 1B are perspective views illustrating one example of a copying apparatus formed in accordance with the present invention.
Figure 1B:
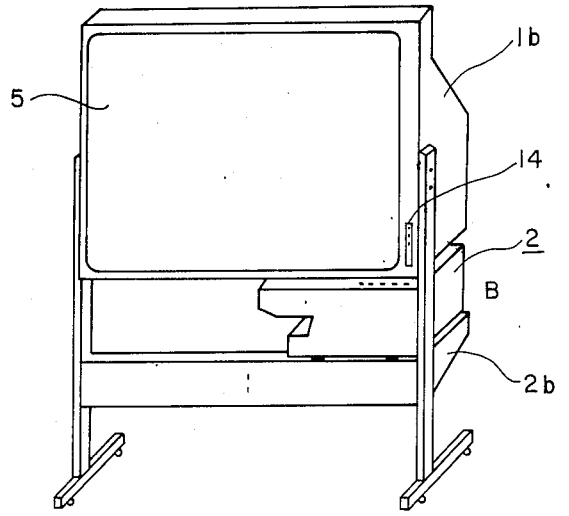
Figure 2:
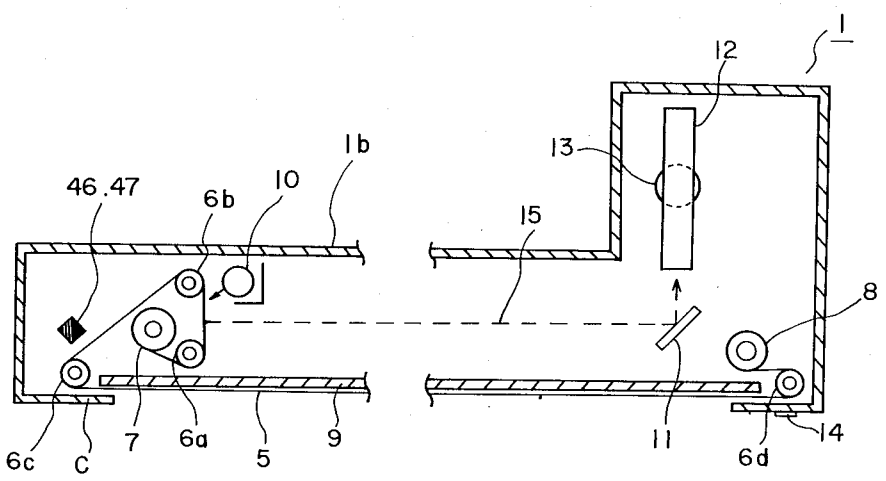
FIG. 2 is a sectional view of the display unit of FIG. 1.

FIGS. 1A and 1B are perspective views illustrating an entire copying apparatus in accordance with the first embodiment of the present invention during operation. FIG. 2 is a sectional view illustrating one arrangement of the display unit.

The copying apparatus includes a display unit 1 and a copying unit 2, which copying unit is movably mounted, both in a forward and backward fashion, on beams **2*b***.

Figure 3:
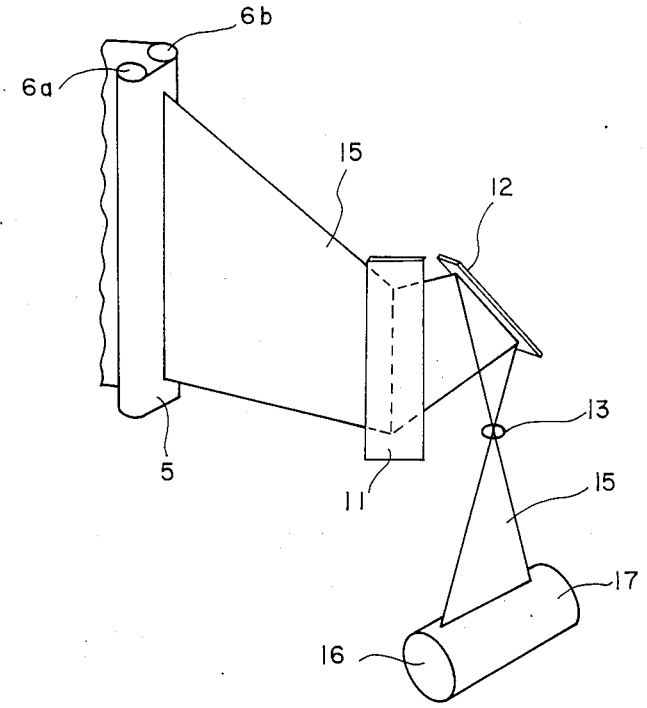
FIG. 3 is an optical system in the display unit of FIG. 1.

As illustrated in FIG. 3, display unit 1 includes a display member 5 in box **1*b*, rollers 6*a*, 6*b*, 6*c* and 6*d*, winding rollers 7 and 8, backup board 9, halogen lamp 10, first and second mirrors 11 and 12 positioned in the display unit, a lens which is also located on the display unit, and an operating panel 14** located at the front end of the display unit.

Display member 5 is wound about winding roller 8, and when exposed and scanned, it is wound through rollers **6*d*, 6*c*, 6*b* and 6*a* by winding roller 7**, which is driven by a (non-illustrated) drive member.

Both the spacing between roller **6*c* and end portion C of box 1*b*, and the spacing between rollers 6*c* and 6*b*, are sufficiently short, in relation to the length of display member 5, that the surface portion of display member 5 on which an image has been written can be moved to halogen lamp 10 for a short time via winding roller 7. Display member 5 is formed from a white and soft sheet of resin material, and that portion of display member 5 which is exposed outside of display unit 1 and backed by back-up board 9** will form an image-written surface on which an operator can write a desired image with a felt pen, as well as erase such an image by a sheet of cloth or other material.

The length of display member 5 corresponds to several pages, whereas the image-written surface of the display member is counted as one page, and the copying operation is carried out on every page.

The moving display member 5 which is being wound will form a surface between rollers 6*a* and 6*b* which is perpendicular to backup board 9 and which is irradiated by halogen lamp 10.

Display member 5, whose image-written face has been copied, is adapted to then be returned to its original position by a motor drive or similar structure when a re-winding button is pushed.

FIG. 3 schematically illustrates an arrangement of an optical system for use with the display unit. Light which is reflected from the image which has been irradiated by halogen lamp 10 is imaged onto surface 17 of photosensitive drum 16 in copying unit 2; the light has passed along passage 15 and through first and second mirrors 11 and 12, and through lens 13 located in the display unit. First mirror 11, located in the display unit, is inclined at 45 degrees with respect to the light passage 15 in order to bend reflected light backwardly and vertically with respect to the surface of display member 5. The reflected light bent in this fashion is further bent downwardly by 90 degrees by a second mirror 12 located in the display unit, is introduced onto photosensitive drum 16 in copying unit 2, passes through lens 13 located in the display unit, and then through an exposure opening in copying unit 2. Because the surface of display member 5 which is irradiated or scanned and exposed by halogen lamp 10 is located on the left end side of display unit 1, i.e., downstream in the direction of movement of the display member with respect to the image-written surface, while copying unit 2, which is provided with photosensitive drum 16, is located on the right side of display unit 1 (i.e., upstream in the direction of movement of the display member relative to the surface on which images are written), the light passage can be made long, using the transverse width of the display unit and a small number of mirrors.

Figure 6:
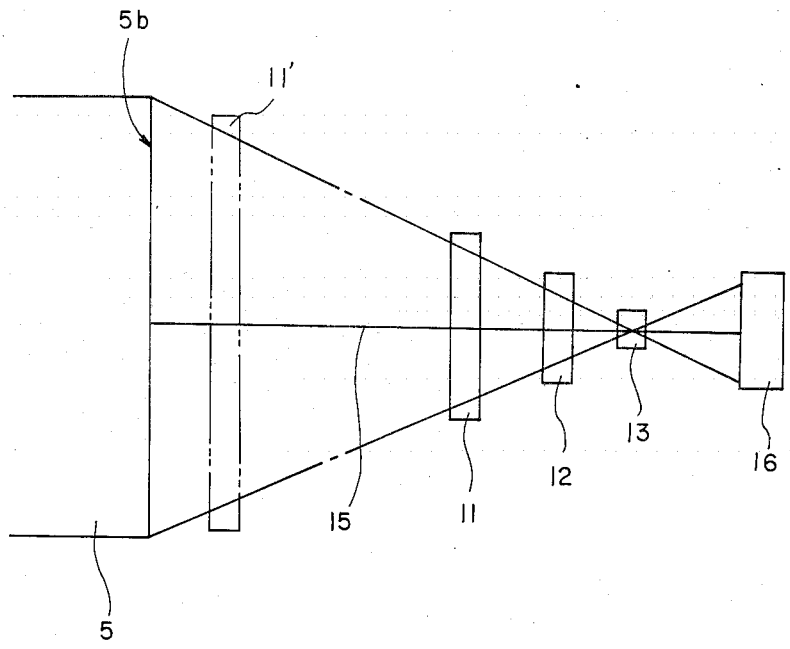
FIG. 6 illustrates the optical system in the display unit of FIG. 1.

FIG. 6 illustrates the optical system in display unit 1. As described above, face 5*b* of display member 5 which is scanned and exposed between rollers 6*a* and 6*b* is arranged in a perpendicular fashion with respect to the image-written surface of the display member. First mirror 11, which is located on the display side, serves to further reflect light reflected from the scanned and exposed surface 5*b* of the display member 5, which can thus be located in a remote fashion from surface 5*b* of display member 5, as illustrated by the solid line in FIG. 6. The dimension of the mirror can accordingly be made small. In addition, the display member can be located adjacent to the display lens, so that the display mirror can be formed integrally with respect to the display lens, and so that both of them can be easily adjusted.

If the scanned and exposed face of display member 5 were not perpendicular to its image-written face, a mirror 11' would have to be located adjacent to the scanned and exposed surface 5*b* of display member 5, and the passage of light reflected by mirror 11' would have to be made parallel to the image-written face of display member 5. The length of such a mirror 11' would then have to be substantially the same as the length of the display member in such a case, thus making the cost high. Further, mirror 11' would be located in a remote fashion from the display lens; accordingly, mirror 11' would need to be arranged with accuracy and it would take a long time to adjust a mirror arranged in such fashion.

Figure 4:
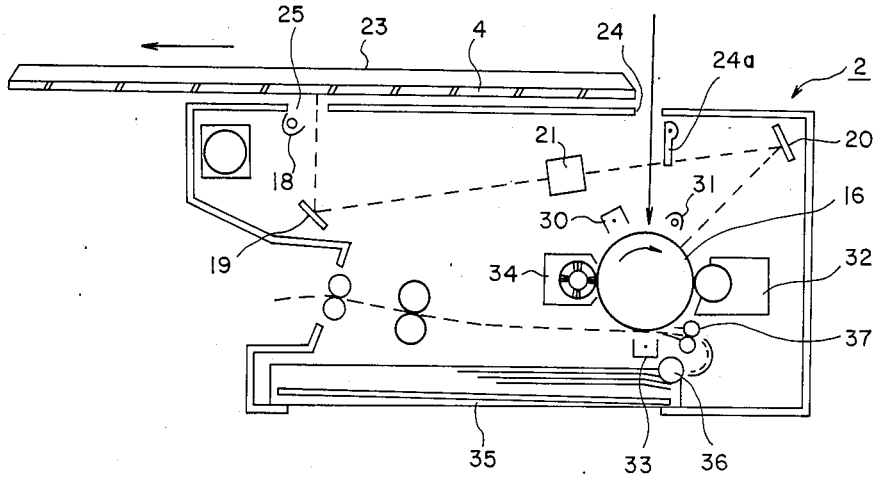
FIG. 4 shows one arrangement of a copying unit.

As illustrated in FIG. 4, copying unit 2 includes photosensitive drum 16, charger 30, blank lamp 31, developing means 32, transferring means 33, and cleaner 34, which are positioned about photosensitive drum 16. The unit also includes a paper supply cassette 35, paper supply roller 36, timing rollers 37, a fixing section for fixing an image which has been transferred to a sheet of paper, a discharge section for discharging the paper outwardly from the unit, and a light scanning mechanism.

The light scanning mechanism comprises a halogen lamp 13 or irradiating originals, first and second copying mirrors 19 and 20, respectively, copying lens 21, and table 4, which table is formed from transparent material and upon which originals to be copied are rested.

Original cover 23 is positioned above original table 4 and is adapted to be freely opened and closed. Display unit 1 includes an exposure opening 24 and copying unit 2 includes an exposure opening 25 which is provided in the upper ceiling plate of copying unit 2. A shutter 24*a*, which is freely opened and closed, is positioned directly under exposure opening 24.

Copying unit 2 is located upstream, in the direction of movement of display member 5 within display unit 1, relative to the portion of the display unit at which the image is written on the display member. The copying unit is also located under the display unit. The section of the display unit on which the image is written on the display member is positioned in a parallel fashion with respect to the direction of movement of original table 4.

When an image on display member 5 is to be copied, copying unit 2 is pushed back to position B, as shown in FIG. 1B. Shutter 24*a* is associated with copying unit 2, as shown in FIG. 4, and exposure opening 24 for display unit 1 is opened while original table 4 is moved in the direction illustrated by the arrow in FIG. 4. This enables the light which passes through display unit 1 to enter copying unit 2. When a copying switch on operation panel 14 is then turned on, the copying apparatus will begin copying the image on display member 5. Simultaneously with operation of copying unit 2, winding roller 7 begins to rotate while halogen lamp 10 is turned on.

Images such as letters and figures which are written on display member 5 are passed between rollers 6*a* and 6*b* at a uniform speed and are irradiated by halogen lamp 10. Light reflected from these images is then imaged onto photosensitive drum 16, passing through mirrors 11 and 12 and lens 13.

When photosensitive drum 16 is light-irradiated, i.e., exposed, an electrostatic latent image is formed on photosensitive drum 16. This latent image on the drum is converted to a toner image by a developer, and the toner image is transferred onto a sheet of paper by transferring means 33. The paper on which the toner image has been transferred is then discharged outwardly from the copying apparatus after it passes through fixing means. Display member 5 which has been copied is then returned to its original position by rotation of roller 8 when a re-winding button is pushed.

The relationship between the image-written surface of the display member and a sheet of paper will now be described.

Figure 7:
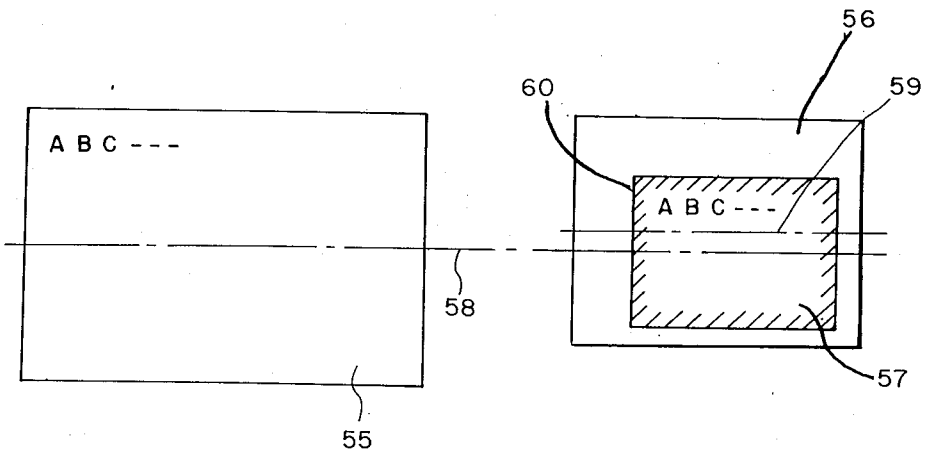
FIG. 7 illustrates a process of forming images in accordance with the present invention.

It is assumed that the dimension of an image 57 which can be formed on copying paper 56 is 270 mm by 183 mm, where the image written on an effective image-written surface 55 is 1300 mm by 880 mm, e.g., and is to copied on copying paper 56 of A4 size, i.e., 297 mm by 210 mm; as illustrated in FIG. 7, the optical system will then be set in such a case to have a reduction ratio of 270/1300=0.208.

Figure 8:
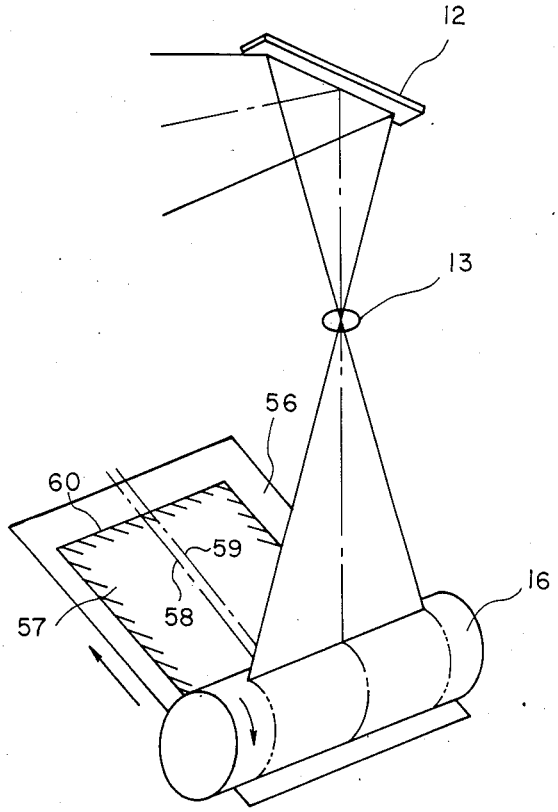
FIG. 8 illustrates the relationship between the optical system and the photosensitive body of the copying apparatus of FIG. 1.

The light passage center line 58 is positioned below copying paper center line 59, and a margin of 17 mm is provided at the upper end portion of copying paper 56 at this time. This margin of 17 mm at the upper end portion of copying paper 56 is provided, following an optical setting which shifts the image position on the surface of photosensitive drum 16 or after a structural setting is selected for shifting the position of photosensitive drum 16, as illustrated in FIG. 8.

A margin of 17 mm is set at the left side of copying paper 56 for an electronically controlled circuit. When the display member initiates its movement in response to a copying command applied from display unit 1, paper supply roller 36 in copying unit 2, as illustrated in FIG. 4, begins its rotation, and the copying paper 56 on top of the stack of copying paper in paper supply cassette 35 is then fed into the conveying passage. Paper supply roller 36 continues to rotate and then stops rotating, with copying paper 56 then in abutment with timing rollers 37; this stop in rotation occurs after the lapse of a predetermined time when copying paper 56, which is fed into the conveying passage, reaches the position at which a sensor (not illustrated) is located. At the same time that the sensor is made operative, a winding signal is applied from copying unit 2 to display unit 1, and winding roller 7 begins to wind display member 5. Halogen lamp 10 is turned on at the same time. The image on display member 5 which is being wound by winding roller 7 is then imaged onto photosensitive drum 16 through first and second display side mirrors 11 and 12 and display side lens 13, and this image is exposed.

Figure 5:
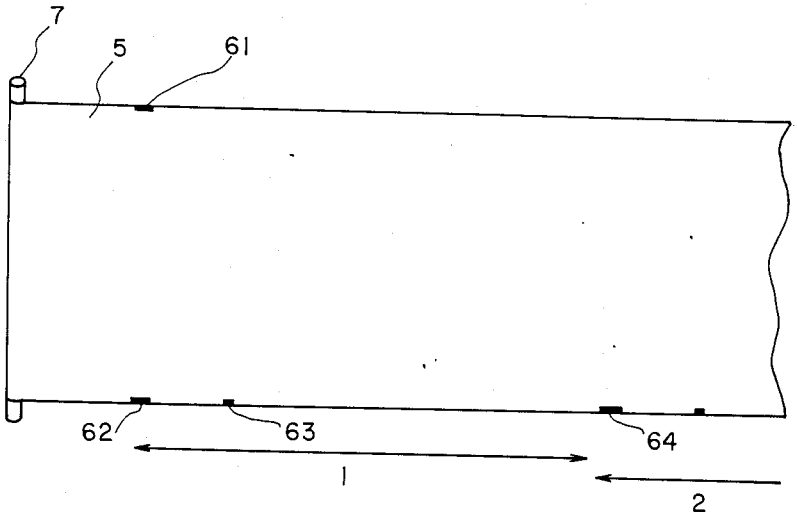
FIG. 5 illustrates one arrangement of a display member of the copying apparatus of FIG. 1.

When a timing mark 63 positioned at the lower edge of display member 5, as shown in FIG. 5, is sensed by a mark sensor 47, a timing signal is applied from display unit 1 to the copying unit 2, and the timing rollers in copying unit 2 which have received the timing signal begin to rotate to feed copying paper, which was left in abutment with timing roller 37, toward the transferring section. The timing mark is positioned on display member 5 so that the forwardmost end of copying paper 56 can precede, by 17 mm, to the transferring section before the forwardmost end of the image on photosensitive drum 16.

The predetermined margin of 17 mm is formed on the left side of the thus-fed copying paper 56, and the toner image on photosensitive drum 16 is transferred to copying paper 56 by transfer means 33 at the transferring section.

A page detecting mark 61, as shown in FIG. 5, is located at the upper edge of display member 5, and is detected by mark sensor 46.

Mark sensor 46 which detects mark 61 enables the device to control the paging of display member 5. Detecting marks 62 and 64, as shown in FIG. 5, are located at the lower edge of display member 5 in order to detect the stop position of each page of the display member.

The margin at the left side of copying paper 56 can be formed in a similar fashion by controlling the timing of the exposure of the photosensitive drum and of the paper supply.

As described above, each of the 17 mm wide margins can be formed at upper and left sides of copying paper 56 in the above-described embodiment.

Although the margins have been described as being formed at the upper and left sides of copying paper 56 in this embodiment, they could equally well be formed at the upper and/or left side ends of copying paper 56.

When a normal copying operation is performed, the copying unit is pulled out to position A, as illustrated in FIG. 1A, and shutter **24*a* is operated to close exposure opening 24 on the display side while documents and reference literature can be copied using original table 4**.

The originals on original table 4 are irradiated by halogen lamp 18 as in a normal optical copying system, and the light reflected from the image on the original is then imaged onto photosensitive drum 16 via first mirror 19, lens 21, and second mirror 20. An electrostatic latent image is then formed on photosensitive drum 16 by this light irradiation, which image is then processed as in a case in which images on the display member are copied.

In accordance with this apparatus, original table 4 is moved so as not to close the display exposure opening 24 when images on display member 5 are being copied. Because copying unit 2 is arranged parallel to display unit 1 and located upstream, in the direction of movement of display member 5, and under display unit 1, that portion of original table 4 which projects outwardly from copying unit 2 is directed in the longitudinal direction of display unit 1 so as to minimize the need for additional space.

Further, original table 4 is scanned in the same direction as the display member is moved, even when images from originals are copied. In this way, the floor area occupied by the copying apparatus can be minimized.

With such a copying apparatus, copying unit 2 is located upstream, in the direction of movement of display member 5, and under display unit 1, and that portion of original table 4 which projects outwardly from copying unit 2 is directed along the longitudinal direction of display unit 1 to minimize the need for additional space.

With a copying apparatus having such an arrangement, a copying unit 2 is located upstream, in the direction of movement of display member 5, and under display unit 1. In this fashion, a long tight passage will be formed using an optical system which includes a small number of reflecting mirrors. Since the copying unit is housed under the display unit when images on the display member are to be copied, image-writing and image-erasing on and from the display member will not be hindered by the copying unit, and picking up copying materials and exchanging elements on the copying unit can be easily performed.

Furthermore, the display mirror is located adjacent to the display lens and they are integrally formed. As a result, both can be easily adjusted.

Still further, the surface of the display member on which images are written is positioned perpendicularly to the surface of the portion of the display member where the images are scanned and exposed. In this fashion, the dimensions of the display unit can be reduced and the copying apparatus can thus be made more compact.

Still further, the display mirror is positioned in a remote fashion from the image exposing position and adjacent to the display lens within the display unit. As a result, the longitudinal dimension of the mirror can be reduced and adjustment of the attached mirror can be easily achieved. Additionally, costs are reduced.

Still further, the margins on the copying paper will prevent the image of the paper from being broken by holes punched when the papers are filed.

Although the above description has been made in a case in which images on both the display member and the transparent original table can be selectively copied, it should be understood that the present invention is not limited to the above-described embodiment but that it can be used as a copying apparatus which can copy only images on a display member.

What is claimed is:

1. A copying apparatus for copying an image written on a display member, said copying apparatus comprising:

(i) a display unit comprising:

(a) a casing having an opening along one surface of said casing;

(b) a plurality of support rolls within said casing, each of said support rolls being rotatable about a vertical axis;

(c) a writeable and erasable display member comprising a sheet which is wrapped about said support rolls and which is adapted to be moved in a horizontal direction in response to rotation of at least one of said support rolls;

(d) said display member including a first portion which is positioned along a first flat plane exposed outside of said casing and along said casing opening, said display member including a second portion positioned along a second flat plane substantially perpendicular to said first flat plane, said second flat plane being adjacent one end of said casing, said first portion of said display member being adapted to move to said one end of said casing to be copied after an image is written on said display member first portion, said second flat plane being located within said casing; and (e) a mirror and lens system located within a second end of said casing opposite from said one end of said casing, said system comprising means for conducting an optical image from the portion of said sheet positioned along said second flat plane of said sheet to a copying unit, wherein said copying unit is positioned beneath said second end of said display member casing; and (ii) a copying unit comprising:

(a) a photosensitive body within said unit;

(b) an opening in said unit, said opening comprising means for receiving the optical image from said mirror and lens system to illuminate said photosensitive body; and (c) means for producing an image on paper corresponding to the optical image received by said photosensitive body.

2. A copying apparatus in accordance to claim 1 wherein said copying unit further comprises a platen for supporting an original document thereon, means for illuminating said document, and means for conveying an optical image, in the form of light reflected from said document, onto said photosensitive body within said copying unit, said copying unit thereby comprising means for copying an original document positioned on said platen.

3. A copying apparatus in accordance with claim 2 wherein said platen is reciprocable along a direction which is parallel to the direction along which said display member portion forming said first flat plane is adapted to be moved by said at least one support roll.

4. A copying apparatus in accordance with claim 1 further comprising means for shifting the center of an image on a sheet to be copied away from the center of the paper onto which it is copied.

5. A copying apparatus for copying an image written on a display member, said copying apparatus comprising:

(a) a display unit which comprises:

(i) a substantially enclosed casing having an opening;

(ii) a plurality of support rolls positioned along the interior of said casing, each of said support rolls being rotatable about a predetermined axis;

(iii) a writeable and erasable display member comprising a sheet wrapped about said support rolls and movable in response to rotation of at least one of said support rolls, said display member having a first portion adapted to form a first flat plane which is exposed along said opening of said casing and a second portion forming a second flat plane perpendicular to said first flat plane, said first portion being adapted to move into the position of said second flat plane after an image has been written on said display member when it is adjacent to said opening and said image containing portion of said display member has been moved by said at least one support roll into the interior of said casing; and (iv) an optical image guiding system comprising at least one mirror and a lens, said optical image guiding system comprising means for guiding an image from said display sheet portion located along said second flat plane outwardly from said display unit and to a copier unit located beneath said display unit; and (b) a copier unit which comprises:

(i) an opening for receiving said optical image guided by said optical image guiding system;

(ii) a photosensitive body adapted to receive said optical image via said opening; and (iii) means for producing an image on paper corresponding to the optical image received by said photosensitive body.

* * * * *

UNITED STATES PATENT AND TRADEMARK OFFICE

CERTIFICATE OF CORRECTION

PATENT NO. : 4,687,318

DATED : August 18, 1987

INVENTOR(S) : Sohei SHIBASAKI et al.

It is certified that error appears in the above-identified patent and that said Letters Patent is hereby corrected as shown below:

At column 1, line 17 of the printed patent, insert ---a--- after "transcription,".

At column 1, line 30 of the printed patent, change "thereform" to ---therefore---.

At column 4, line 14 of the printed patent, change "or" to ---for---.

At column 4, line 16 of the printed patent, insert ---a--- before "table 4", delete the "," after "table 4", and delete the second occurrence of "table".

At column 5, lines 1 and 2 of the printed patent, insert ---be--- after "to".

At column 6, line 46 of the printed patent, change "tight" to ---light---.

Signed and Sealed this

Sixteenth Day of August, 1988

*Attest:*

DONALD J. QUIGG

*Attesting Officer*

*Commissioner of Patents and Trademarks*